US009120210B2

(12) United States Patent
Lee et al.

(10) Patent No.: US 9,120,210 B2
(45) Date of Patent: Sep. 1, 2015

(54) OPEN WRENCH

(71) Applicants: Tsan-Chang Lee, Taichung (TW); Yueh-Li Wang, Taichung (TW)

(72) Inventors: Tsan-Chang Lee, Taichung (TW); Yueh-Li Wang, Taichung (TW)

( * ) Notice: Subject to any disclaimer, the term of this patent is extended or adjusted under 35 U.S.C. 154(b) by 245 days.

(21) Appl. No.: 13/951,505

(22) Filed: Jul. 26, 2013

(65) Prior Publication Data

US 2015/0027278 A1 Jan. 29, 2015

(51) Int. Cl.
*B25B 13/08* (2006.01)
*B25B 23/00* (2006.01)

(52) U.S. Cl.
CPC ..... *B25B 13/08* (2013.01); *B25B 23/00* (2013.01)

(58) Field of Classification Search
CPC ..... B25B 13/08; B25B 23/00
See application file for complete search history.

(56) References Cited

U.S. PATENT DOCUMENTS 5,148,726 A * 9/1992 Huebschen et al. ..... 81/119
5,860,339 A * 1/1999 Mikic et al. ..... 81/186
6,009,778 A * 1/2000 Hsieh ..... 81/119
6,145,414 A * 11/2000 Hsieh ..... 81/119
6,755,098 B2 * 6/2004 Huang ..... 81/119
7,168,347 B2 * 1/2007 Hsieh ..... 81/186
7,261,020 B2 * 8/2007 Hsieh ..... 81/121.1
7,661,339 B2 * 2/2010 Wu ..... 81/186
7,788,994 B2 * 9/2010 Wright et al. ..... 81/119
8,359,952 B2 * 1/2013 Hsieh ..... 81/119
8,667,873 B2 * 3/2014 Hsieh ..... 81/186
2004/0020332 A1 * 2/2004 Hsieh ..... 81/186
2004/0255728 A1 * 12/2004 Hsieh ..... 81/186
2007/0295170 A1 * 12/2007 Hsieh ..... 81/119

* cited by examiner

*Primary Examiner* — David B Thomas

(57) ABSTRACT

An open wrench includes a body having a mounting hole defined therethrough. Two first faces and two second faces are respective defined in the inside of the mounting hole. The two first faces and the two second faces are located along four consecutive sides of an imaginary hexagonal body. Each first face has at least two teeth defined therein. Five curved faces are defined in the inside of the mounting hole and located corresponding to five corners of the imaginary hexagonal body. Each of the first and second faces has a contact face and each contact face is connected between two adjacent curved faces. The length of each contact face is 0.5-0.65 of the length of each side of the imaginary hexagonal body.

6 Claims, 7 Drawing Sheets

OPEN WRENCH

FIELD OF THE INVENTION

The present invention relates to an open wrench, and more particularly, to an open wrench having teeth and curved faces so as to prevent from damaging the corners of the object.

BACKGROUND OF THE INVENTION

A conventional open wrench is shown in FIG. 7 and generally includes a body 40 having two faces 41 and a curved face 42 which is connected between the two faces 41. When the two faces 41 clamp an object 30 and the body 40 is rotated, there are gaps between the object 30 and the two faces 41, such that the corners of the object 30 are worn out by the two faces 41 and become rounded corners.

Taiwan Utility Model No. 088220749 invented by the present inventor, which discloses an open wrench with four faces for clamping a hexagonal object. Two of the four faces are parallel to each other, and an angle of degrees is defined between the other two faces. Each of the two parallel faces has at least one tooth and at least curved face, and three curved faces are formed at the connection portions between the four faces so that the object can be securely clamped and driven. When the open wrench is rotated to drive the object, the corners of the object are protected from being worn out by being positioned in the two curved faces and the three curved faces. There are two parallel sides, two faces, teeth two curved recesses and three curved recesses. In other words, there are five factors (two parallel sides, two faces, teeth two curved recesses and three curved recesses) to form the open wrench. There are over forty different specifications for the objects, including the objects of Metric and English systems. If each open wrench needs to set the five factors, the manufacturers have to spend significant time and cost to manufacture the open wrenches for all of the objects of different sizes and systems.

The present invention intends to provide an open wrench which needs only four factors to be set so as to reduce the time and cost required.

SUMMARY OF THE INVENTION

The present invention relates to an open wrench and comprises a body having a mounting hole defined therethrough. An opening is defined in the body and communicates with the mounting hole. Two first faces and two second faces are respectively defined in the inside of the mounting hole. The two first faces and the two second faces are located along four consecutive sides of an imaginary hexagonal body. The two second faces are located between the two first faces. Each first face has at least two teeth defined therein. Five curved faces are defined in the inside of the mounting hole. Two of the five curved faces are respectively defined in the two first faces. One of the five curved faces is defined in the connection portion between the two second faces. The other two curved faces are respectively defined in two respective connection portions between the first and second faces. Each of the first and second faces has a contact face and each contact face is connected between two adjacent curved faces. The at least two teeth of each first face are defined in the contact face. The length of each contact face is a first length. A second length is defined as the width of the at least two teeth along the contact face. Each of the curved faces has a first radius. The length of each side of the imaginary hexagonal body is a third length. The first length is 0.5-0.65 of the third length. The distance between two parallel sides of the imaginary hexagonal body is eight times of the first radius. The center of each curved face is located on one of the corners of the imaginary hexagonal body.

The primary object of the present invention is to provide an open wrench which protects the corners of the object from being worn out.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
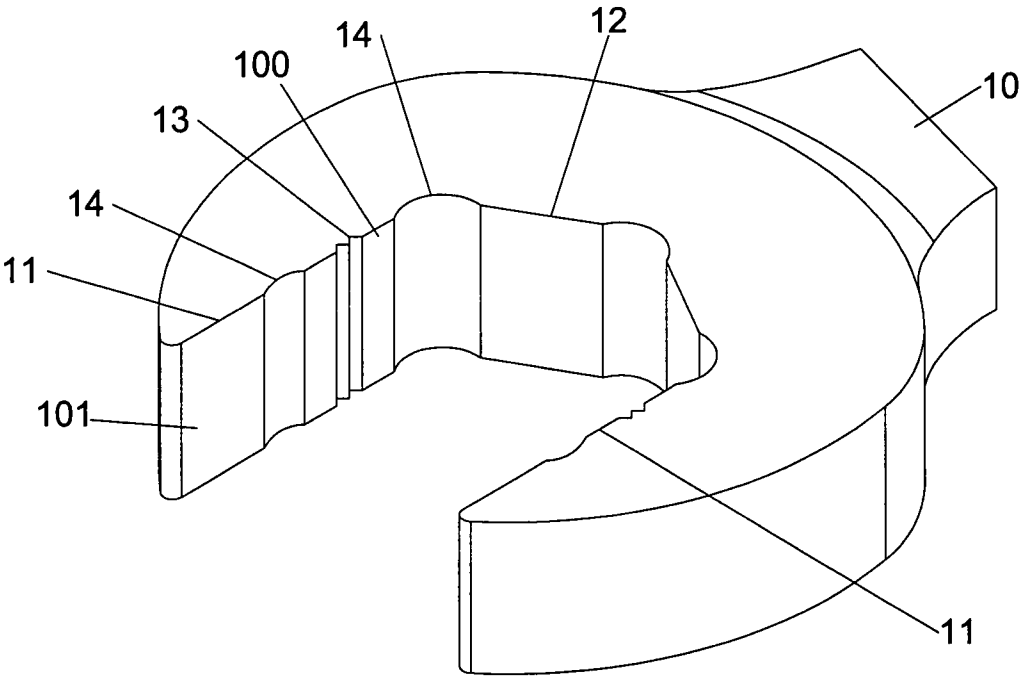
FIG. 1 is a perspective view to show the open wrench of the present invention.
Figure 2:
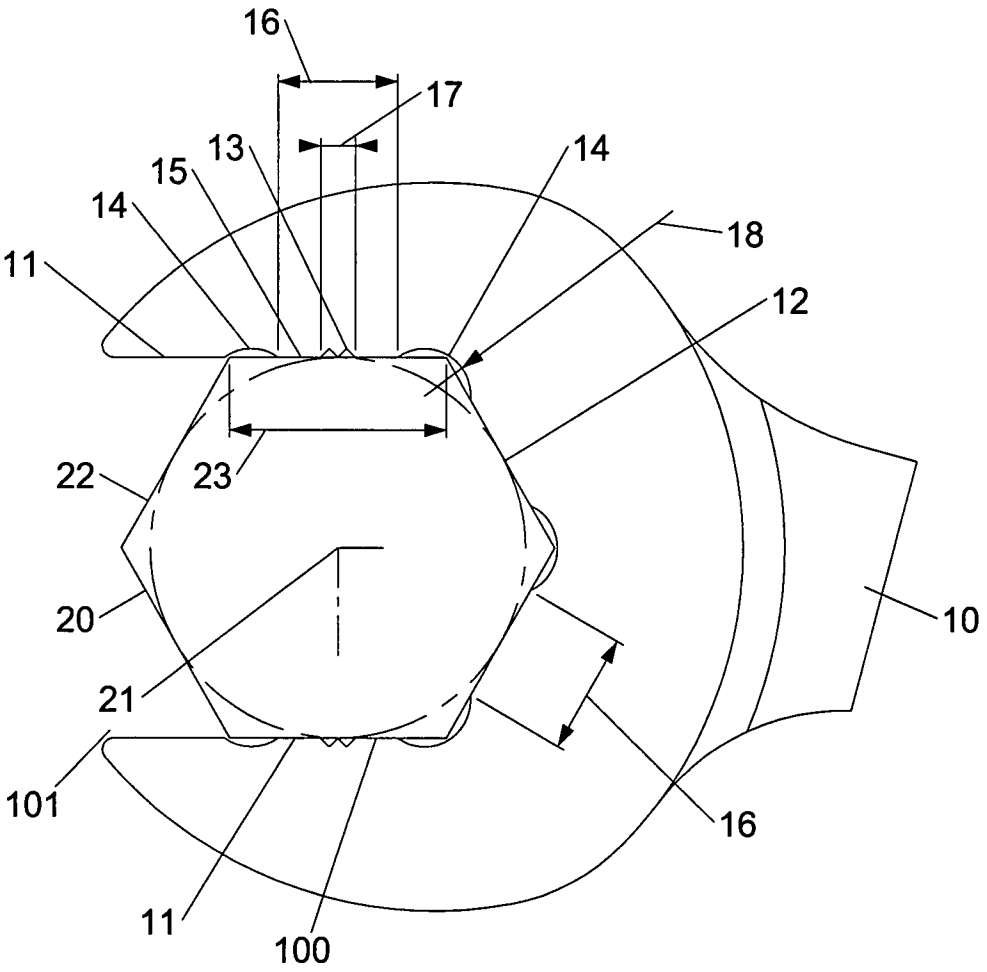
FIG. 2 is a top view of the open wrench of the present invention.

Referring to FIGS. 1 and 2, the open wrench of the present invention comprises a body 10 having a mounting hole 100 defined therethrough. An opening 101 is defined in the body 10 and communicates with the mounting hole 100. Two first faces 11 and two second faces 12 are respectively defined in the inside of the mounting hole 100. The two first faces 11 and the two second faces 12 are located along four consecutive sides of an imaginary hexagonal body 20. The two second faces 12 are located between the two first faces 11. Each first face 11 has two teeth 13 defined therein. The two teeth 13 of each of the first faces 11 are consecutive teeth, and a V-shaped recess is defined between the two teeth 13 of each of the first faces 11. There are five curved faces 14 defined in the inside of the mounting hole 100. Two of the five curved faces 14 are respectively defined in the two first faces 11. One of the five curved faces 14 is defined in a connection portion between the two second faces 12. The other two curved faces 14 are respectively defined in two respective connection portions between the first and second faces 11, 12. Each of the first and second faces 11, 12 has a contact face 15, and each contact face 15 is connected between two adjacent curved faces 14. The two teeth 13 of each first face 11 are defined in the contact face 15. The length of each contact face 15 is a first length 16, and a second length 17 is defined as the width of the two teeth 13 along the contact face 15. Each of the curved faces 14 has a first radius 18. The length of each side of the imaginary hexagonal body 20 is the third length 23. The first length 16 is 0.5-0.65 of the third length 23. The distance between the two parallel sides 22 of the imaginary hexagonal body 20 is eight times of the first radius 8. The center of each curved face 14 is located on one of corners of the imaginary hexagonal body 20. If the third length 23 is 10 mm, the first length 16 is between 5 mm to 6.5 mm. The distance between the two parallel sides 22 of the imaginary hexagonal body 20 is 32 mm. The first radius 18 is 4 mm.

Figure 3:
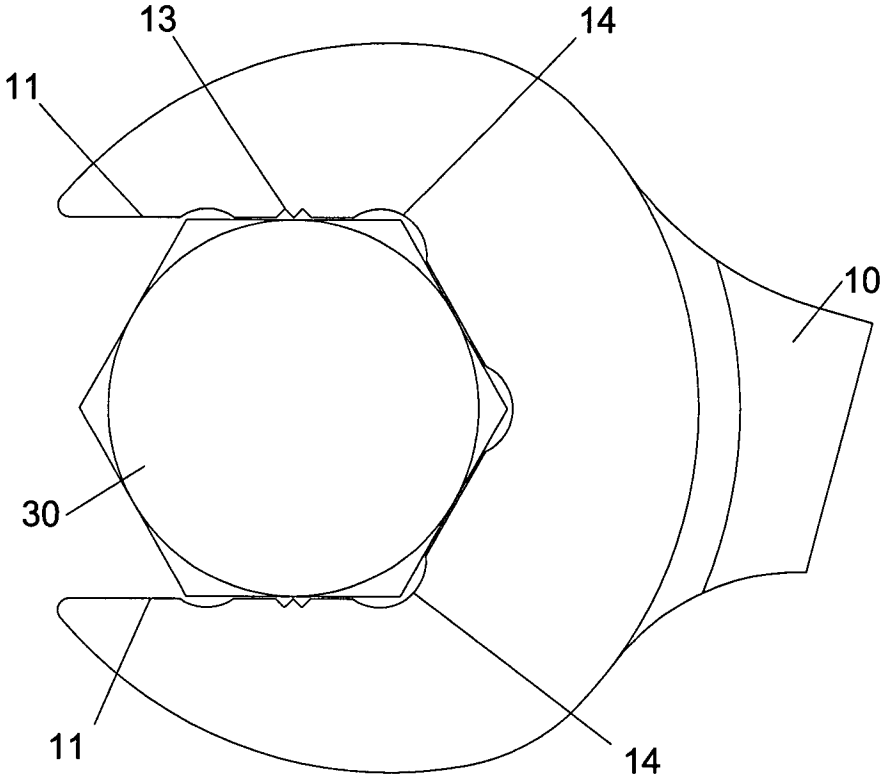
FIG. 3 shows that an object is mounted by the open wrench of the present invention.

As shown in FIG. 3, when the open wrench is mounted to an object 30, the two first faces 11 and the two second faces 12 clamp the four sides of the object 30, the corners of the object 30 are located in the curved faces 14, so that the corners are protected when the object 30 is rotated.

Figure 4:
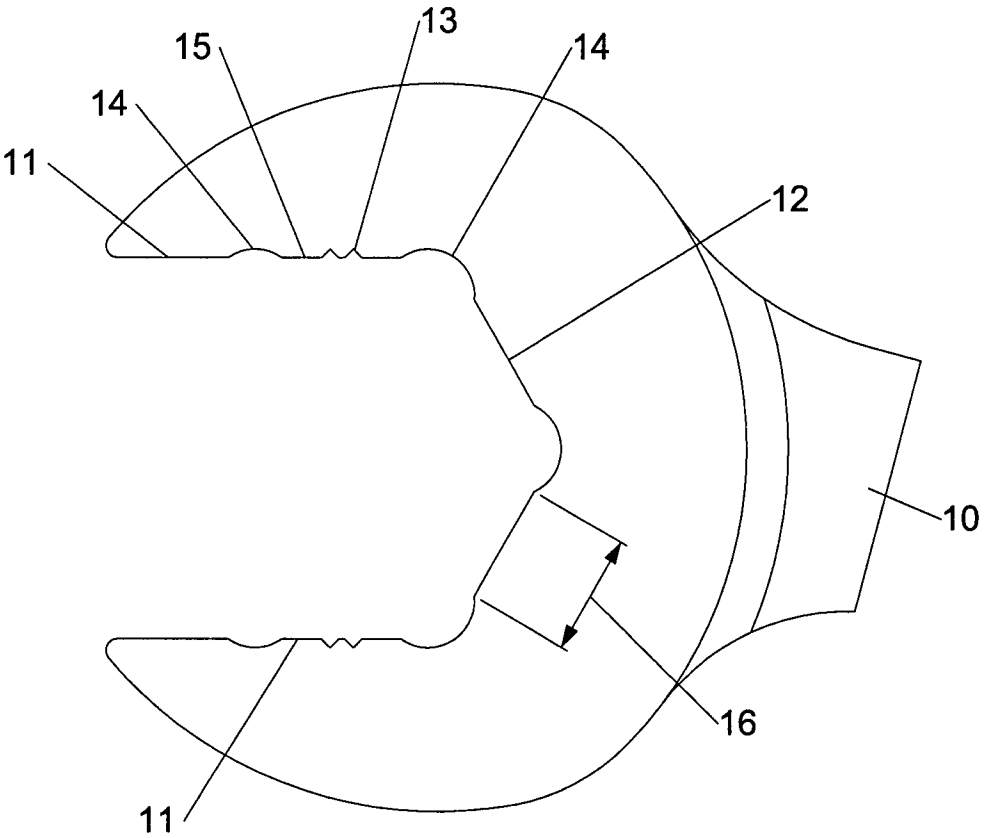
FIG. 4 is a top view of the second embodiment of the open wrench of the present invention.

As shown in FIG. 4, each tooth 13 is a concavity and a distance is formed between the two teeth 13 which are not consecutive teeth.

Figure 5:
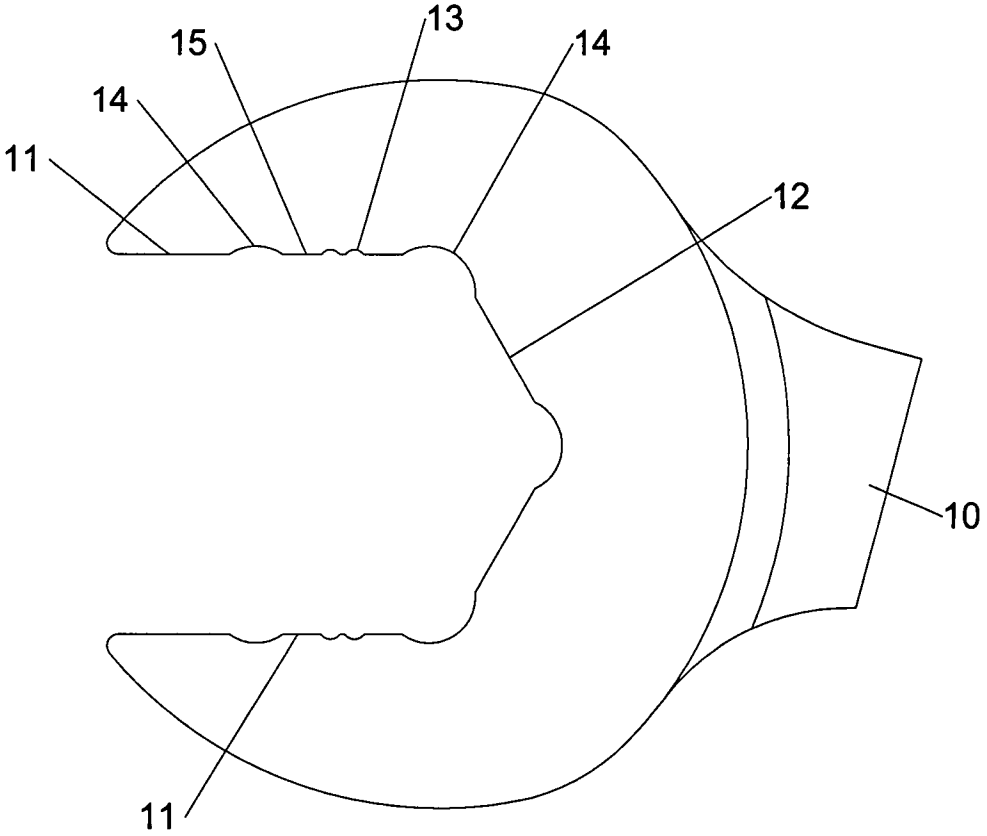
FIG. 5 is a top view of the third embodiment of the open wrench of the present invention.

As shown in FIG. 5, a curved recess is defined between the two teeth 13 of each of the first faces 11.

Figure 6:
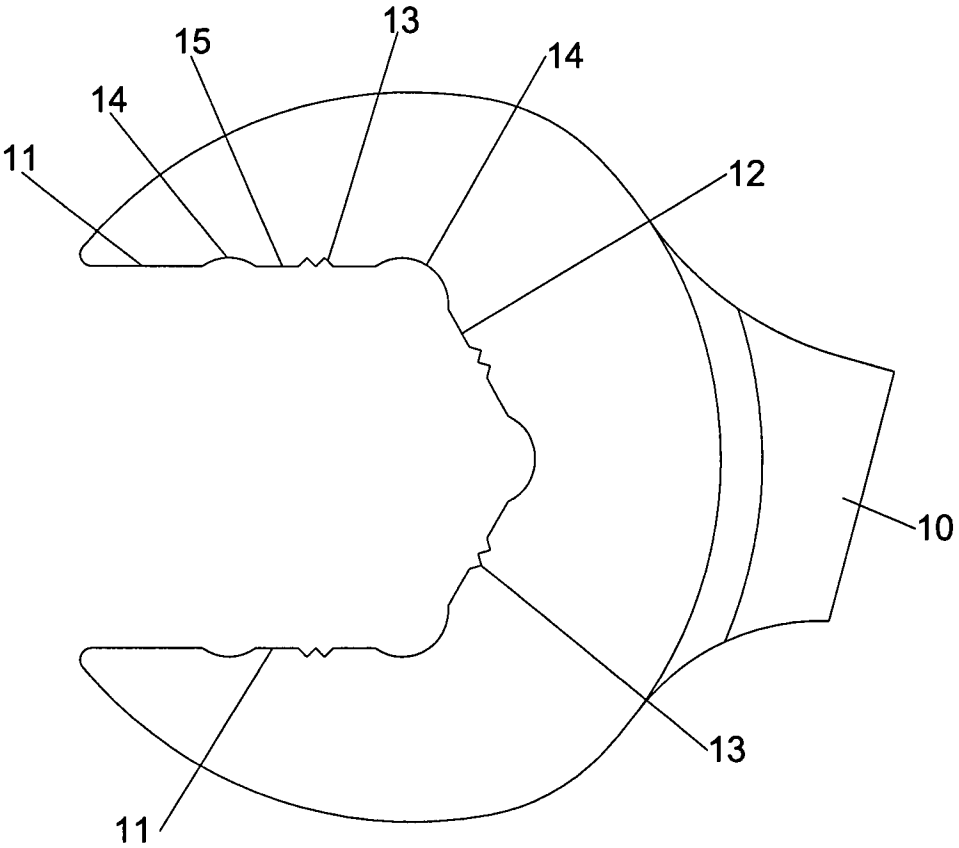
FIG. 6 is a top view of the fourth embodiment of the open wrench of the present invention.
Figure 7:
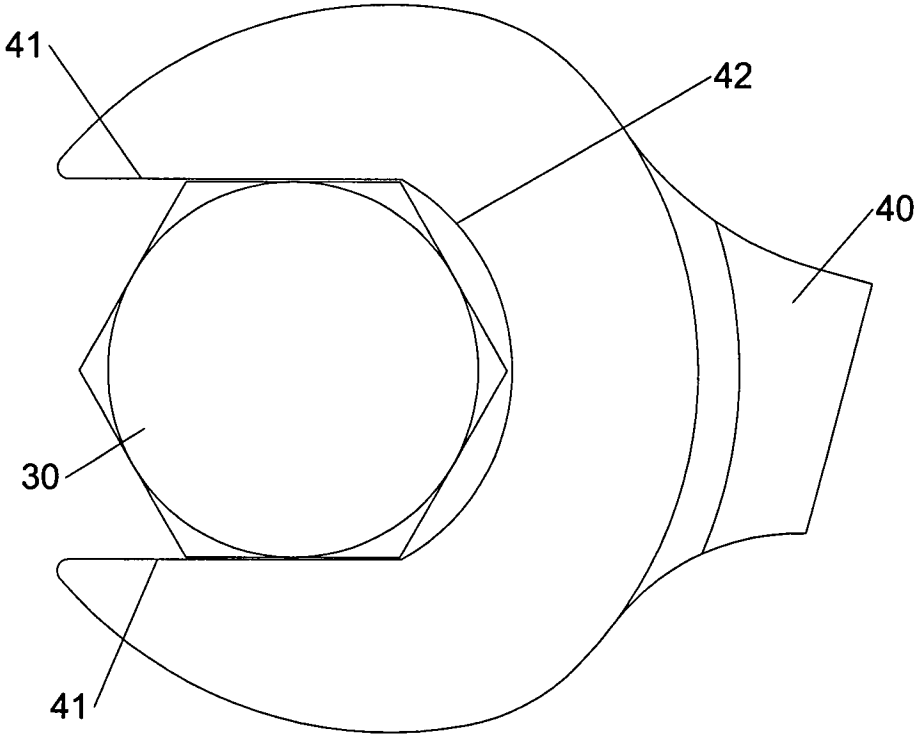
PRIOR ART FIG.7
FIG. 7 shows the conventional open wrench.

As shown in FIG. 6, each of the first and second faces 11, 12 has multiple teeth 13.

The advantages of the present invention are that the body 10 has two first faces 11, two second faces 12, multiple teeth 13, five curved faces 14, only four factors are needed to be set for the open wrench of the present invention, so that the time and manufacturing cost are reduced.

The length of each contact face 15 is the first length 16, and the first length 16 is 0.5-0.65 of the third length 23. Therefore, there is at least 1.75 times of the distance between two jaws of open wrench located between the corners and the contact faces 15, the corners of the object are protected when the object is rotated.

The two first faces 11 each have at least one tooth 13 and a curved face 14, and the three curved faces 14 are formed at the connection portions of the two first faces 11 and the two second faces 12. Therefore, the object 30 can be securely clamped and is easily rotated.

While we have shown and described the embodiment in accordance with the present invention, it should be clear to those skilled in the art that further embodiments may be made without departing from the scope of the present invention.

What is claimed is:

1. An open wrench comprising:

a body having a mounting hole defined therethrough, an opening defined in the body and communicating with the mounting hole, two first faces and two second faces respectively defined in an inside of the mounting hole, the two first faces and the two second faces located along four consecutive sides of an imaginary hexagonal body, the two second faces located between the two first faces, each first face having at least two teeth defined therein, five curved faces defined in the inside of the mounting hole, two of the five curved faces respectively defined in the two first faces, one of the five curved faces defined in a connection portion between the two second faces, the other two curved faces respectively defined in two respective connection portions between the first and second faces, each of the first and second faces having a contact face, each contact face connected between two adjacent curved faces, the at least two teeth of each first face defined in the contact face, a length of each contact face being a first length, a second length being defined as a width of the at least two teeth along the contact face, each of the curved faces having a first radius, a length of each side of the imaginary hexagonal body being a third length, the first length being 0.5-0.65 of the third length, a distance between two parallel sides of the imaginary hexagonal body being eight times of the first radius, a center of each curved face located on one of corners of the imaginary hexagonal body.

2. The open wrench as claimed in claim 1, wherein the at least two teeth of each of the first faces are consecutive teeth.

3. The open wrench as claimed in claim 1, wherein the at least two teeth of each of the first faces are not consecutive teeth.

4. The open wrench as claimed in claim 1, wherein a V-shaped recess is defined between the at least two teeth of each of the first faces.

5. The device as claimed in claim 1, wherein a curved recess is defined between the at least two teeth of each of the first faces.

6. The device as claimed in claim 1, wherein each second face has at least two teeth defined therein.

* * * * *